United States Patent [19]

Felix et al.

[11] Patent Number: 4,653,153

[45] Date of Patent: Mar. 31, 1987

[54] METHOD AND DEVICE FOR THE OPTIMIZATION OF THE DRAWING PROCESS ON AUTOLEVELLER DRAWFRAMES IN THE TEXTILE INDUSTRY

[75] Inventors: Ernst Felix, Uster; Peter Feller, Benglen, both of Switzerland

[73] Assignee: Zellweger Uster Ltd., Uster, Switzerland

[21] Appl. No.: 776,664

[22] Filed: Sep. 16, 1985

[30] Foreign Application Priority Data

Sep. 25, 1984 [CH] Switzerland ..... 4584/84

[51] Int. Cl.[4] ..... D01H 5/32

[52] U.S. Cl. ..... 19/240; 19/105; 19/258; 57/93

[58] Field of Search ..... 19/240, 258, 239, 259, 19/260; 57/93, 94, 95, 97, 100

[56] References Cited

U.S. PATENT DOCUMENTS

| | | | |
|---|---|---|---|
| 3,099,048 | 7/1963 | Locher | 19/240 |
| 4,336,684 | 6/1982 | Hartmannsgruber et al. | 19/240 X |
| 4,369,550 | 1/1983 | Meile | 19/240 |
| 4,506,414 | 3/1985 | Krieger | 19/240 |
| 4,574,433 | 3/1986 | Brunnschweiler | 19/240 X |
| 4,589,168 | 5/1986 | Krieger | 19/240 |

*Primary Examiner*—Louis K. Rimrodt
*Assistant Examiner*—J. L. Olds
*Attorney, Agent, or Firm*—Antonelli, Terry & Wands

[57] ABSTRACT

A rapidly reacting measuring element is used at the delivery of the drafting zone on autolevelling drawframes used in the textile industry, which makes it possible to superimpose on the signal thus obtained from the measuring element by means of an electronic system a further measurement signal at the delivery of the drawing passage and thus correct the parameters governing the drafting values in such a way that even short-term variations in cross-section of the textile material are levelled out. The critical factors here are especially the delay time T of the textile material between the correcting element (pair of drafting rollers with variable speed of rotation) and the measuring element and also the overall amplification V of the measurement signal.

16 Claims, 9 Drawing Figures

METHOD AND DEVICE FOR THE OPTIMIZATION OF THE DRAWING PROCESS ON AUTOLEVELLER DRAWFRAMES IN THE TEXTILE INDUSTRY

BACKGROUND OF THE INVENTION

The present invention relates to a method and device for the optimization of the drawing process on autoleveller drawframes in the textile industry.

In the textile industry, the function of an autoleveller drawframe is to draw out slivers of textile fibers by a factor of four to eight and thus make them as uniform as possible. The most frequently occurring type of these autoleveller drawframes operates in short-staple spinning (e.g., in cotton spinning) on the principle of the closed control loop. Here the textile material is drawn out in a drafting zone in proportion to the peripheral speeds of two pairs of drafting rollers (equal to the amount of draft). In a measuring element at the end of the drafting zone, the cross-section of the sliver is measured and the value thus obtained is compared against a target value. The resultant error signal acts in known fashion upon the amount of draft through a correcting element.

In long-staple spinning, most autoleveller drawframes operate on the principle of the open control loop. In such a system, the sliver cross-section entering the drafting unit is measured by a measuring element and the draft is controlled accordingly. It is important here to take into account both the delay time T of the sliver between the measuring element and the correcting element and also the overall amplification V of the signal between the measuring element and the correcting element.

In a closed control loop, on the other hand, because of the so-called dead time between the drafting zone and the measuring element, it is not possible to equalize short-term variations in cross-section. To improve matters, i.e., to equalize short-term variations as well, it is possible to add a second measuring element located before the autoleveller drafting unit. This cooperates with the autoleveller drafting unit as an open control loop. Thus, a combination of an open and a closed control loop is achieved within the same autoleveller drafting unit.

Furthermore, it is known that in open control loops it is not very easy to accurately adjust the overall amplification V and the delay time T in the control elements for the open control loop. Theoretically, it should be possible to determine precisely the delay time T from the point of time of measurement to the action in the correcting element. This is not the case in practice, however. Furthermore, this delay time is also influenced by mass effects. Additional influences are exerted by special features occurring in the drafting of fibrous slivers. Appropriate information on this has been provided in the technical literature.

Similar circumstances apply also to the overall amplification V. It might be thought that the target draft in the drafting zone could be established theoretically from the measurement signal. However, for the same practical reasons this solution cannot be considered. In most cases, therefore, adjustment is made empirically by autolevelling the sliver, then checking on the testing apparatus and finding the optimum of the comparison by changing the parameters.

SUMMARY OF THE INVENTION

The present invention takes into account these special circumstances and concerns a method and a device for optimization of the drafting process on autoleveller drawframes in the textile industry.

It is the primary object of the present invention to provide a method and apparatus for controlling the drafting process on autoleveller drawframes which avoids the problems and disadvantages inherent in the prior art.

More particularly, the invention provides a method for the optimization of the drawing process on autoleveller drawframes in the textile industry with at least one open control loop and one further measuring element at the delivery of the autoleveller drawframe, a characteristic feature of which is that the signal obtained by at least one measuring element at the delivery of the autoleveller drawframe is transmitted to an electronic system which acts upon the control parameters for overall amplification and/or delay timing of the electronic control system of the open control loop.

The invention also provides a device for performing the above-mentioned method, which includes a circuit responsive to the output signal of the measuring element at the delivery of the autoleveller drawframe for controlling the open control loop by adjusting the amplification and/or delay timing of the electronic control system of the open control loop, such as by correlation of the measuring signals received from the measuring element in the open control loop and the measuring element at the delivery of the autoleveller drawframe.

BRIEF DESCRIPTION OF THE DRAWINGS

The invention is explained in greater detail by reference to the accompanying drawings, wherein.

DETAILED DESCRIPTION OF THE PREFERRED EMBODIMENTS

Figure 1:
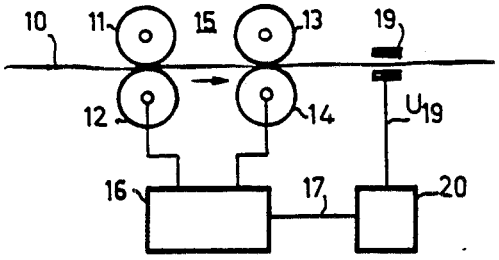
FIG. 1 is a schematic diagram showing the principle of an autoleveller drawframe with closed control loop.

FIG. 1 shows a closed control loop for an autoleveller drawframe. The textile material 10 passes through a drafting zone formed by a rear pair of drafting rollers 11, 12 and a front pair of drafting rollers 13, 14. The front pair of drafting rollers 13, 14 is driven at a peripheral speed faster by a factor of 4 to 8 than the rear pair of drafting rollers; and at least one pair of drafting rollers has its rotational motion imparted by a governor gearbox with electonic power circuit 16 to which signals for maintaining specific speed ratios are transmitted through a control input 17.

The textile material 10 leaving the drafting zone 15 passes through a first measuring element (measuring transducer) 19, the output signal $U_{19}$ of which is compared against a target value in an electronic control system 20 and is transformed in such a way that an appropriate control signal for controlling the drafting is transmitted to the control input 17. The output signal $U_{19}$ corresponding to the cross-section of the delivered textile material 10 thus acts upon the speed ratio of the pairs of drafting rollers with the purpose of levelling out the textile material 10.

Figure 2:
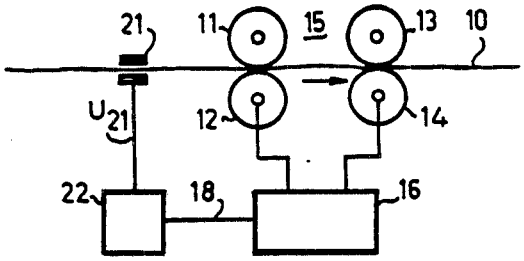
FIG. 2 is a schematic diagram showing the principle of an autoleveller drawframe with an open control loop.

In FIG. 2, another form of control loop is represented which is known as an open control loop. Here, a further measuring element (measuring transducer) 21 is provided in the region of the textile material 10 passing through the drafting zone 15, which measures its cross-section and transforms the corresponding test signal $U_{21}$ into a control signal in a further electronic control circuit 22, and this acts upon the delivery speed through the control input 17 or a further control input 18 of the governor gearbox 16. It is important here that account is taken of both the delay time T between the time the sliver passes the measuring element 21 and the time the same part of the sliver reaches the correcting element, i.e., the drafting zone 15, and also the overall amplification V of the measurement signal $U_{21}$ for changing the correcting element (i.e., the speed ratio). Delay time T and overall amplification V are thus parameters of the open control loop.

Figure 6:
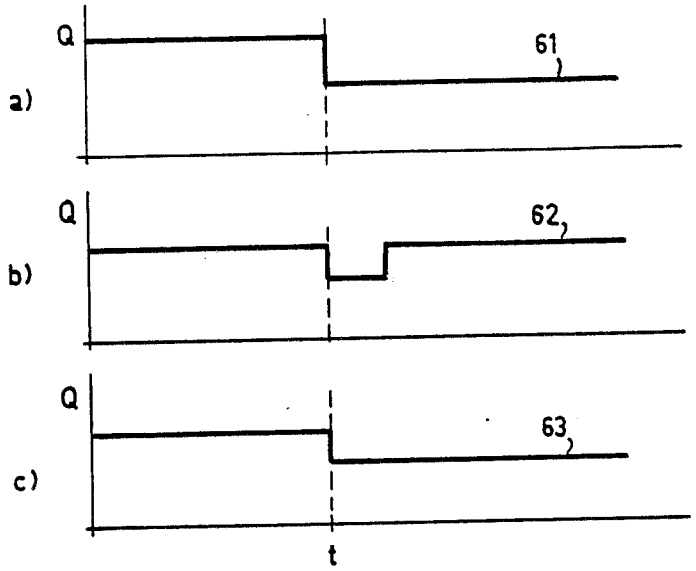
FIG. 6 is a waveform diagram representing the waveforms showing a sudden change in input signal with insufficient adjustment of delay time and overall amplification.
Figure 7:
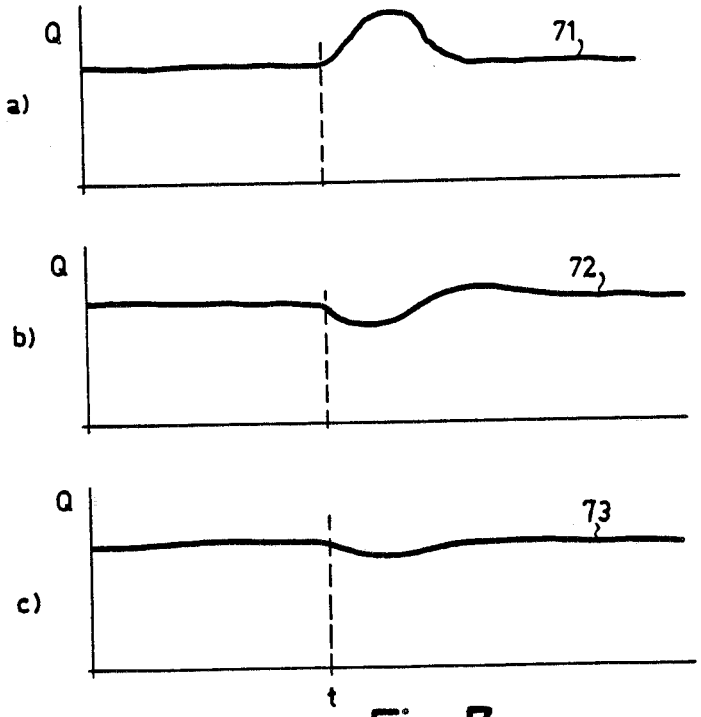
FIG. 7 is a waveform diagram representing the waveforms showing a short-term change in input signal with insufficient correction of delay time and overall amplification.

Appreciation of the influence of the amplification V or of the delay time T on the resultant change in irregularity is particularly striking when it is related to individual events. FIGS. 6 and 7 serve this purpose. The first example selected is the phenomenon known as a "step". This occurs with some approximation in practice when one sliver is broken on entering a zone. The total sliver cross-section is thus reduced at entry suddenly at point t in time by 10 to 20 percent, depending on the number of slivers being fed into the drafting unit (FIG. 6*a*). With complete autolevelling action, the sliver cross-section 61 should remain constant at the delivery. If, however, for example, the delay time T has been set too high, but the overall amplification is correct, then a curve 62 of the cross-section Q is obtained as in FIG. 6*b*. On the other hand, if the delay time T is correct, but the overall amplification adopted is too low, then a curve 63 as shown in FIG. 6*c* is to be expected.

FIG. 7 represents the cross-section curve 71 with a sporadic thickening of the sliver. With the delay time T too short, i.e., correction applied too soon, a curve 72 is produced. Curve 73 indicates the cross-section of the delivery sliver when the overall amplification is too high, but with correct delay time T. The error detected as sporadic thickening of the sliver at the entry to the drafting unit is thus overcompensated.

Figure 3:
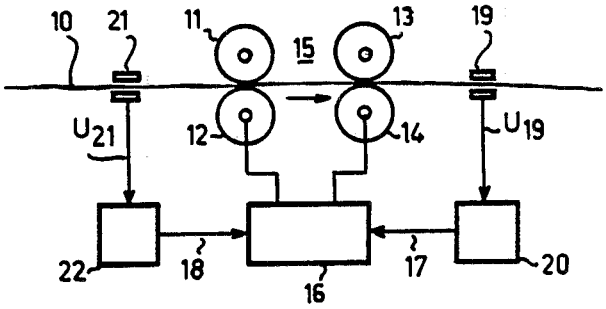
FIG. 3 is a schematic diagram showing the principle of an autoleveller drawframe with a combination of open and closed control loops.

In a closed control loop as shown in FIG. 1, because of the so-called dead time between drafting zone 15 and measuring element 19, it is not possible to level out short-term variations in cross-section. As already mentioned, an improvement which provides at least partial smoothing out even of the short-term variations can be achieved by a further second measuring element 21, which is located before the control drafting unit 11–16, through use of a further electronic control system 22 (FIG. 3). Thus, a combination of an open and a closed control loop with one and the same drafting unit is achieved.

Measuring elements 19 of the type utilized until a short time ago for measuring the cross-section of textile material 10 at the delivery of autoleveller drawframes were not able to measure the cross-section with sufficiently low inertia. Consequently, it was not possible to determine the short-term variations in cross-section of the textile material 10. For this purpose, the textile material had to be measured on special laboratory testing equipment. On the other hand, a rapid reaction of the measuring element 19 was also unnecessary for the dead time in the closed control loop would not have permitted levelling out of the short-term variations in cross-section anyway.

Recently, measuring elements have become known which allow almost inertia-free measurement also at the delivery of autoleveller drawframes, and thus make possible the measurement of short-term variations in cross-section. A measuring element of this type is for example described in European Patent disclosure No. 0 069 833 A1. This measuring element, in addition to its function in the closed control loop, also now permits evaluation of the setting of the control parameters of the open control loop. This evaluation can, however, today be performed also automatically by means of electronics (computer evaluation) and, finally, optimization of the control characteristics of the open control loop can also be performed automatically.

Figure 4:
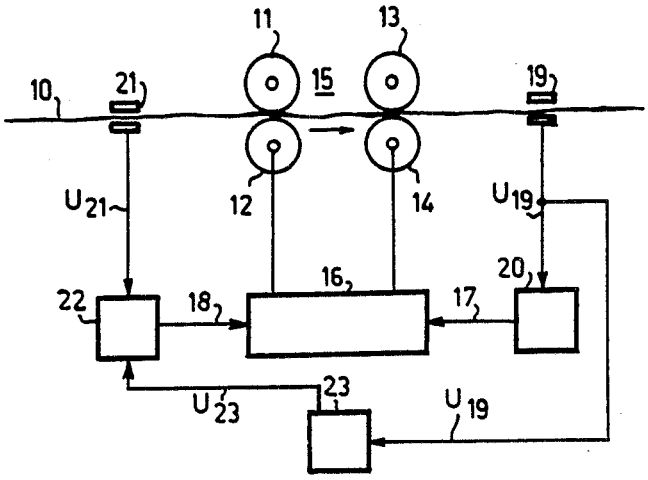
FIG. 4 is a schematic diagram showing the principle of an autoleveller drawframe with open control loop and feedback of a delivered sliver value.

The invention, as seen in FIG. 4, additionally comprises the introduction in principle of a further closed control loop which takes signals at least from the measuring element 19, transforms them in a further electronic circuit 23 and acts upon the parameters in the electronic control system 22 of the open control loop. Thus, this further closed control loop in accordance with the invention does not act directly upon the autoleveller drawframe, but operates on the control parameters of the open control loop.

The purpose of the following explanation is to make clear the mode of operation of the autoleveller drawframe arrangement shown in diagram form in FIG. 4. The irregularity of the delivered sliver cross-section is measured by the measuring element 19. The overall amplification V of the control electronic system 22 is now intentionally modified by a certain amount gradually or in steps. This change will exert an influence on the irregularity of the textile material 10. If it is improved, then a further increase in amplification can be performed. This can be continued until the irregularity increases again. In this case, reverse correction must be undertaken. Thus, the circuit 23 may be provided simply in the form of a microprocessor which monitors the signal $U_{19}$ as it varies the control signal $U_{23}$ to vary the amplification V to minimize the measured irregularity in the sliver. A corresponding analog version of the circuit 23 would be within the ability of one of ordinary skill in this art.

The same empirical approximation can also be performed with the delay time T. Mofifications can also be made alternately both to overall amplification V and to delay time T and their effect on the irregularity monitored. In any case, however, means should be used which adjust the change in overall amplification V or the delay time T at preset points in time by specific amounts.

Instead of measuring the total irregularity in the sliver, it can also be advantageous to measure only the amplitude of the cross-sectional variations of the textile material for one or more discrete wavelengths and to analyze the effect of the change in overall amplification or delay time only for this one or for the selected wavelengths. Theoretically, a complete levelling out of cross-sectional variations is possible for a single wavelength, and for several wavelengths, for example, it is possible to aim at a minimum. In selecting the wavelengths to be analyzed, the factors of decisive importance are the characteristics of the drafting unit, the dimensions, the type of correcting element and others. The available relevant literature is to be referred to in this regard for those not familiar with this technical field.

Figure 5:
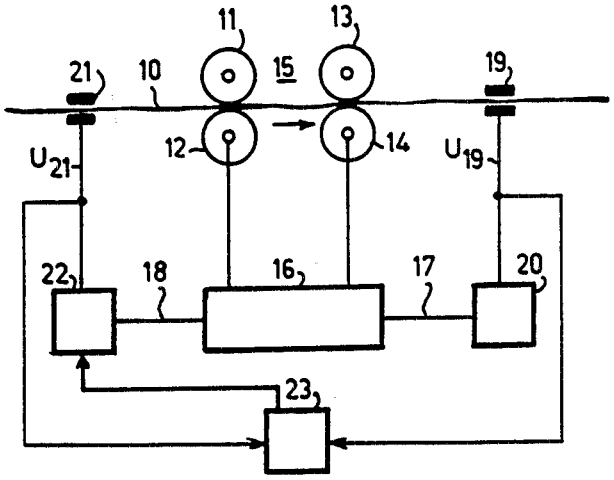
FIG. 5 is a schematic diagram showing a variation of the embodiment in accordance with FIG. 4.

FIG. 5 shows a variant of the autoleveller drawframe control of FIG. 4. Here, the measurement signal $U_{19}$ after passing through the electronic circuit 23 is transmitted to the input of the electronic control system 22 situated in the open control loop. Determination of the control parameters of the electronic control system is made possible by correlation of the two measurement signals $U_{19}$ and $U_{21}$. For example, if a specific phenomenon is detected at measuring element 21 (variation of cross-section), then it is possible to check precisely by means of measuring element 19 whether the overall amplification V and the delay time T are at their optimum settings, or in which direction and by what amount still further corrections are to be made. Any intentional modification of overall amplification V and/or delay time T can thus be dispensed with.

Figure 8:
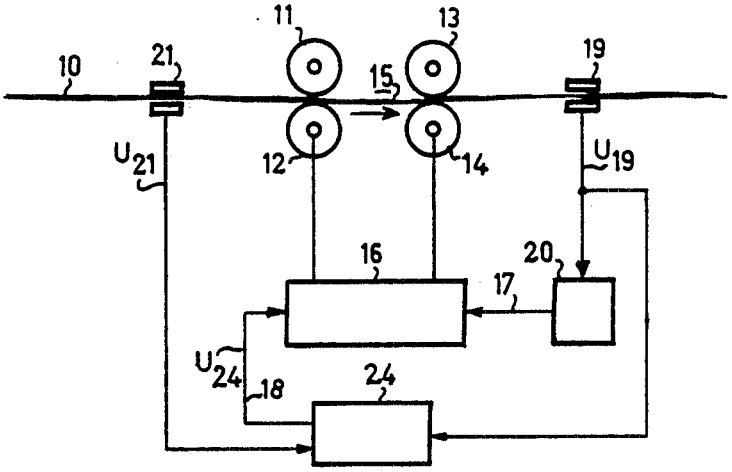
FIG. 8 is a schematic diagram showing a variation of the embodiments in accordance with FIGS. 4 and 5.

In line with the now customary integration of circuits, an advantageous arrangement as shown in FIG. 8 may be attained by combining the electronic control system 22 and the electronic system 23 in one master electronic system 24. It may also be mentioned that both the overall amplification V and the delay time T over the wavelength zone of the variations in cross-section do not need to be constant values. They may be variable as a function of the wavelengths to be corrected.

Figure 9:
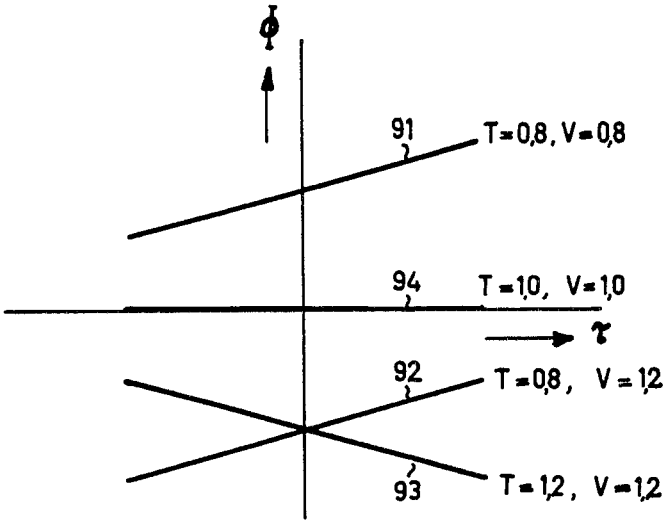
FIG. 9 is a diagram showing certain correlation equations.

The correlations mentioned above may be understood to be simple mathematical functions, such as for example addition or multiplication, or also known correlation functions, such as, for example, cross-correlation. The cross-correlation function $\phi=f(\tau)$ is especially suitable. The examples in FIG. 9 show this very vividly. If $\phi=f(\tau)$ increases as portrayed by lines 91 or 92, then the delay time T adopted in the control system is too small and vice versa (line 93). If the amplification V is too small, then $\phi=f(\tau)$ becomes positive at $\tau=T$ (line 91) and vice versa (lines 92 and 93). Here, T and V are standard values.

Correctly set values for T and V ($T=1.0$, $V=1.0$) produce a line 94 along the axis of the abcissa. It thus suffices to have the purely mathematical value $\tau$ varied in order to detect how the delay time T and the amplification V are to be set. Emperical changes of T and V are thus unnecessary in the present invention.

While we have shown and described various embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

What is claimed is:

1. A method for controlling the drawing process on autoleveller drawframes in the textile industry, wherein textile material is passed through a drafting zone formed by front and rear pairs of drafting rollers, comprising the steps of measuring the cross-section of the textile material before it reaches said drafting zone to produce a first test signal representing said measured cross-section, amplifying said first test signal and supplying said amplified first test signal with a selected delay as a control signal; controlling the speed of at least one of said front and rear pairs of drafting rollers in response to said control signal; measuring the cross-section of said textile material after it passes from said drafting zone to produce a second test signal; and controlling at least one of the amplification and the delay of said first test signal forming said control signal on the basis of said second test signal.

2. A method according to claim 1, wherein both the amplification and the delay of said first test signal are controlled on the basis of said second test signal.

3. A method according to claim 2, wherein said first and second test signals are correlated according to a predetermined function and said amplification and delay of said first test signal are controlled on the basis of the results of said correlation.

4. A method according to claim 3, wherein only selected wavelength components of said first and second test signals are correlated.

5. A method according to claim 1, wherein said first and second test signals are cross-correlated and said amplification and/or delay of said first test signal is controlled on the basis of said cross-correlation.

6. A method according to claim 1, wherein said step of controlling at least one of the amplification and delay of said first test signal comprises, varying at least one of the amplification and delay of the first test signal, detecting the affect of said varying of the amplification and/or delay on said second test signal, and again varying the amplification and/or delay of said first test signal in a direction which produces a reduction in any irregularity of the textile material indicated by said second test signal.

7. An apparatus for controlling the drawing process on autoleveller drawframes in the textile industry, wherein textile material is passed through a drafting zone formed by front and rear pairs of drafting rollers, comprising: first means for measuring the cross-section of the textile material before it reaches said drafting zone to produce a first test signal representing said measured cross-section; means for amplifying said first test signal and for supplying said amplified first test signal with a selected delay as a control signal; speed control means for controlling the speed of at least one of said front and rear pairs of drafting rollers in response to said control signal; second means for measuring the cross-section of said textile material after it passes from said drafting zone to produce a second test signal; and control means for controlling at least one of the amplification and the delay of said first test signal forming said control signal on the basis of said second test signal.

8. An apparatus according to claim 7, wherein both the amplification and the delay of said first test signal are controlled by said control means on the basis of said second test signal.

9. An apparatus according to claim 8, wherein said control means includes means for correlating said first and second test signals according to a predetermined function and for controlling said amplification and delay of said first test signal on the basis of the results of said correlation.

10. An apparatus according to claim 9, wherein said correlating and controlling means correlates only selected wavelength components of said first and second test signals.

11. An apparatus according to claim 7, wherein said control means comprises means for cross-correlating said first and second test signals and for controlling said amplification and/or delay of said first test signal on the basis of said cross-correlation.

12. An apparatus according to claim 7, wherein said control means comprises means for varying at least one of the amplification and delay of the first test signal, for detecting the effect of said varying of the amplification and/or delay on said second test signal and for again varying the amplification and/or delay of said first test signal in a direction which produces a reduction in any irregularity of the textile material indicated by said second test signal.

13. An apparatus according to claim 12, wherein said control means comprises a computer.

14. An apparatus according to claim 7, wherein said amplifying means, said speed controlling means and said control means are formed as a single integrated circuit.

15. An apparatus according to claim 7, wherein said second measuring means comprises a measuring element of the type which produces an output signal which follows all cross-sectional variations of the textile material at least approximately without inertia.

16. An apparatus according to claim 7, wherein said second measuring means comprises a measuring element which operates on the principle of fiber wave propagation.

* * * * *